United States Patent [19]

Santanna

[11] 4,167,884

[45] Sep. 18, 1979

[54] PIGGY BACK SLOTTER BLADES

[75] Inventor: Robert J. Santanna, Astoria, N.Y.

[73] Assignee: S&S Corrugated Paper Machinery Co., Inc., Brooklyn, N.Y.

[21] Appl. No.: 909,835

[22] Filed: May 26, 1978

[51] Int. Cl.[2] ..... B26D 1/28; B26D 3/14

[52] U.S. Cl. ..... 83/671; 83/332; 83/698; 83/917; 93/58.2 R

[58] Field of Search ..... 83/671, 668, 332, 917, 83/698; 93/58.2 R

[56] References Cited

U.S. PATENT DOCUMENTS

| | | | |
|---|---|---|---|
| 3,003,403 | 10/1961 | Goettsch | 93/58.2 R |
| 3,036,486 | 5/1962 | Wilcox | 83/671 |
| 3,211,066 | 10/1965 | Palamenti | 83/332 X |

*Primary Examiner*—Frank T. Yost

*Attorney, Agent, or Firm*—Ostrolenk, Faber, Gerb & Soffen

[57] ABSTRACT

A blade for a rotary slotter is constructed by rigidly securing two arcuate blade sections in abutting end to end relationship by utilizing a keying element force fitted into complementary slots extending to the abutting ends of the blade sections.

7 Claims, 6 Drawing Figures

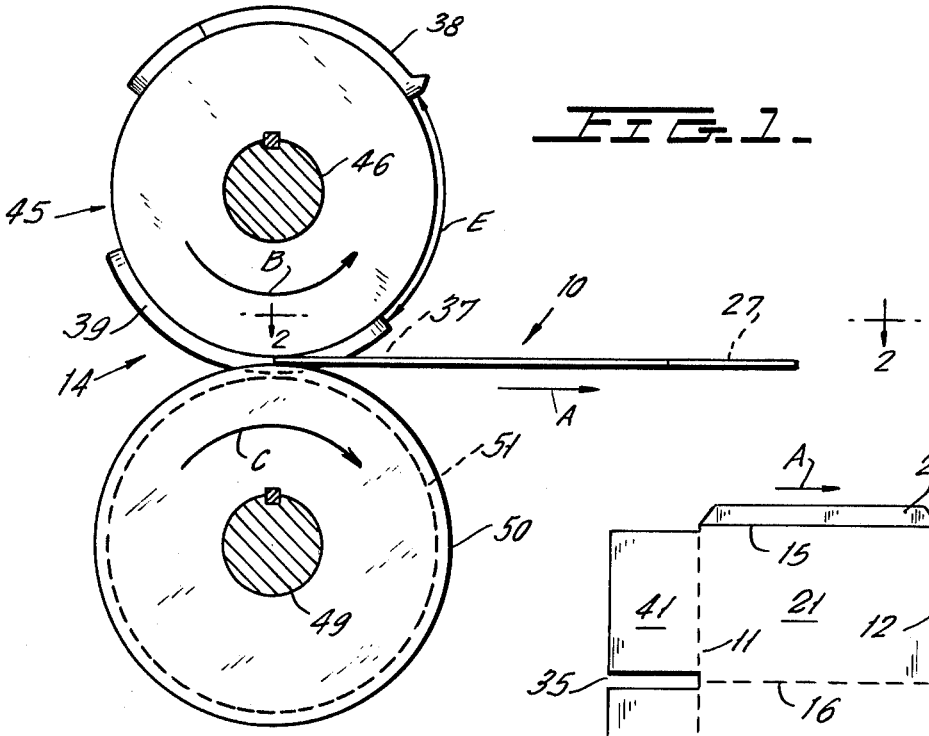
FIG. 1.
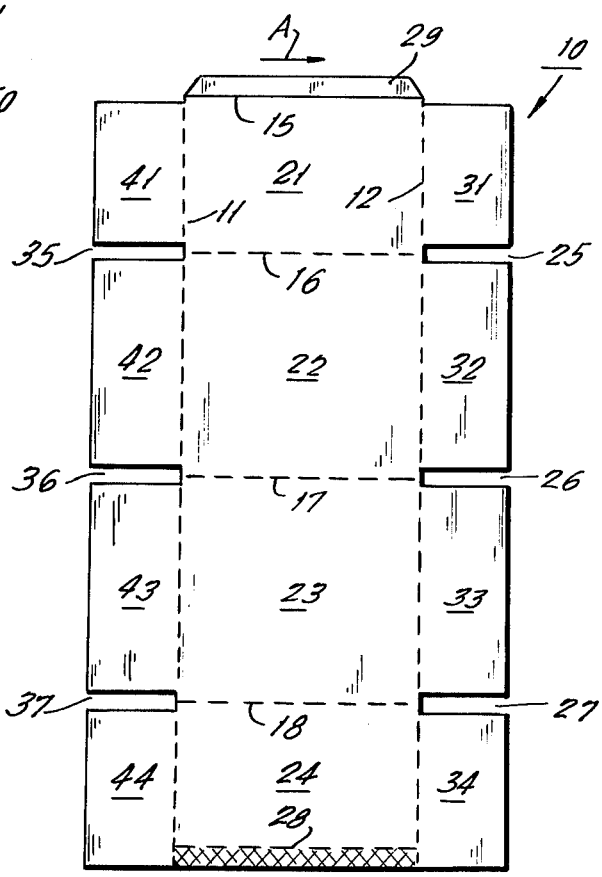
FIG. 2.
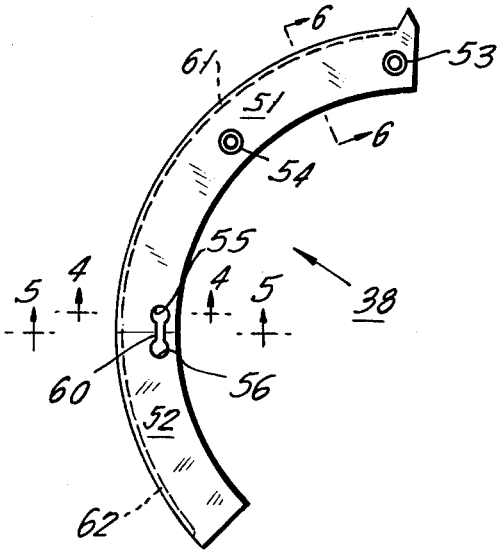
FIG. 3.
FIG. 6.
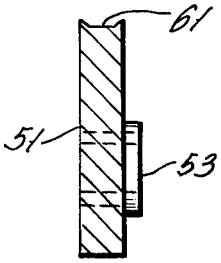
FIG. 5.
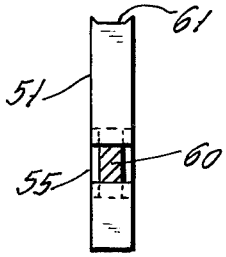
FIG. 4.
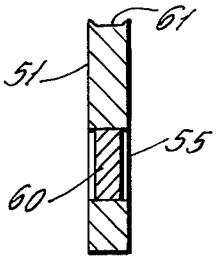

PIGGY BACK SLOTTER BLADES

This invention relates to automatic box making apparatus in general and more particularly relates to the construction of blades for a rotary slotter.

For the most part, the slotting, scoring, creasing and slitting of box blanks is accomplished by utilizing a press-type die cutter or a rotary device. The latter has become increasingly popular because of reduced costs when box sizes are changed. That is, for a relatively large range of box sizes there is no need to change rotary slotter blades. Instead, these blades merely have to be adjusted angularly with respect to the slotter heads and/or axially with respect to the drive shaft for the slotter head.

The diameter of the rotary slotter head limits slotter blade length. This is especially true when one box blank is produced for each revolution of the slotter head. Further, for skip feed operation when only one blank is produced for each two revolutions of the slotter head, the leading and trailing edge slotter blade must abut one another so that each is instrumental in cutting both the leading and trailing edge slots.

The prior art has found it expensive to produce long slotter blades and to stock a relatively large assortment of blade sizes. To alleviate this condition, the instant invention provides a slotter blade construction in which blade length may be increased economically by connecting blade sections in tandem. This permits continuous utilization of a basic blade length, and when longer blade lengths are required relatively short add-on sections are secured to the basic blade.

Accordingly, a primary object of the instant invention is to provide a novel construction for slotter blades of relatively long lengths.

Another object is to provide a rotary slotter blade constructed of a plurality of sections connected end to end.

Still another object is to provide a rotary slotter blade having means for rigidly connecting blade sections end to end.

These objects as well as other objects of this invention shall become readily apparent after reading the following description of the accompanying drawings in which:

FIG. 1 is a schematic showing a side elevation of a rotary slotter head just after it has operated in transforming a sheet of corrugated board into a box blank.

FIG. 2 is a plan view looking in the direction of arrows 2—2 of FIG. 1, showing the box blank of FIG. 1.

FIG. 3 is a side elevation of a slotter blade constructed in accordance with teachings of the instant invention.

FIGS. 4, 5 and 6 are cross-sections of the slotter blade of FIG. 3 taken through the respective lines 4—4, 5—5 and 6—6 looking in the direction of the respective arrows 4—4, 5—5 and 6—6.

Now referring to the Figures. 2 shows box blank 10 produced by passing a sheet of corrugated board (not shown) having transverse score lines 11, 12 through rotary slotter 14 and a rotary creaser (not shown). The latter makes longitudinal score lines 15–18 separating panels 21–24 from each other, crushes cross-hatched area 28 and crushes glue lap 29. Slotter 14 cuts slots 25–27 separating flaps 31–34 from one another, and slots 35–37 separating flaps 41–44 from each other, and also cuts glue lap 29. Each pair of longitudinally aligned slots, say 27 and 37, is cut by blades 38, 39 of rotary slotter head 45 keyed to main drive shaft 46 for rotation thereby.

Driven shaft 49, below and parallel to main shaft 46, has wheel 50 keyed thereto in operative position to support blank 10 from below during cutting by slotter blades 38, 39. Wheel 50 is provided with peripheral anvil slot 51 constituting a female knife into which slotter blades 38, 39 extend during simultaneous rotation of head 45 and wheel 50. The rotational directions of head 45 and wheel 50 are indicated by the respective arrows B, C, and the direction of movement of blank 10 is indicated by arrow A. It should now be apparent that slotter blade 38 cuts leading edge slot 27 and slotter blade 39 cuts trailing edge slot 37. It should also be apparent that other individual sections each consisting of a head 45 and a wheel 50 are provided to cut each of the other sets 25, 35, and 26, 36 of longitudinally aligned slots.

U.S. Pat. No. 3,985,066 issued Oct. 12, 1976 to W. M. Kern for a Single Point Means for Slotter Adjustment describes means for angularly adjusting slotter blades 38, 39 relative to one another to set the spacing therebetween equal to the body length E of blank 10. Body length, or the length of each of the side panels 21–24, corresponds to the distance between transverse score lines 11, 12.

Slotter blade 38, shown in detail in FIGS. 3–6, consists of main section 51 and add-on section 52. Circular protrusions 53, 54 extending from one side of main section 51 are received by complementary apertures (not shown) in head 45 to relatively key blade 38 to head 45 in a manner explained in the aforesaid U.S. Pat. No. 3,985,066.

The abutting ends of sections 51, 52 are provided with aligned keying apertures 55, 56 respectively which receive force fitted dogbone shaped fastening element 60. The latter is preferably constructed of aluminum whereas blade sections 51, 52 are constructed of hardened steel.

Sections 51, 52 connected by element 60 form a rigid assembly which is readily handled prior to mounting slotter blade 38 to head 45. With sections 51, 52 assembled their respective slightly concave arcuate cutting edges 61, 62 are aligned in a continuous arc of substantially uniform radius formed about a common center, so that the blade assembly 38 functions in the same manner as a single relatively long slotter blade. The length of section 51 by itself is sufficient for slotting in a wide range of box sizes.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Blade means for a rotary slotter, said blade means comprising first and second blade sections each having an arcuate cutting edge and being positioned in a common plane; fastening means securing said blade sections together in abutting end to end relationship when said blade means is both mounted to and dismounted from a slotter head; said cutting edges combining to form a continuous relatively long arcuate cutting edge of uniform radius and formed about a common axis.

2. Blade means as set forth in claim 1 in which the fastening means includes a member having keying formations at opposite ends thereof disposed in complementary recesses at the abutting ends of said blade sections.

3. Blade means as set forth in claim 1 in which the fastening means includes a member forced fitted into complementary recesses at the abutting ends of said blade sections.

4. Blade means as set forth in claims 1, 2 or 3 in which only one of said first and second blade sections includes means for rotary securement of said blade means to a slotter head.

5. Blade means as set forth in claim 1 in which said first blade section includes laterally extending protrusions adapted to extend into recesses of a slotter head for rotary securement of said blade means to such slotter head.

6. Blade means as set forth in claim 5 in which said first blade section is substantially longer than said second blade section.

7. Blade means as set forth in claim 3 in which the member is constructed of aluminum and each of the blade sections is constructed of hardened steel.

* * * * *